United States Patent [19]

Ogiyama

[11] Patent Number: 4,851,874

[45] Date of Patent: Jul. 25, 1989

[54] DEVELOPING APPARATUS FOR IMAGE RECORDER

[75] Inventor: Hiromi Ogiyama, Tokyo, Japan

[73] Assignee: Ricoh Company, Ltd., Tokyo, Japan

[21] Appl. No.: 167,116

[22] Filed: Mar. 11, 1988

[30] Foreign Application Priority Data

Mar. 12, 1987 [JP] Japan ..... 62-57781

[51] Int. Cl.[4] ..... G03G 15/08

[52] U.S. Cl. ..... 355/253; 355/269; 355/245; 118/657

[58] Field of Search ..... 355/3 TR, 3 R, 30 D, 355/14 D; 118/647, 657, 658

[56] References Cited

U.S. PATENT DOCUMENTS

| | | | |
|---|---|---|---|
| 4,445,771 | 5/1984 | Sakamoto et al. | 118/647 X |
| 4,521,098 | 6/1985 | Hosoya et al. | 355/30 D |
| 4,528,937 | 7/1985 | Kanno et al. | 355/30 D X |
| 4,575,220 | 3/1986 | Sakamoto et al. | 355/30 D |
| 4,632,535 | 12/1986 | Nagata | 355/30 D |

*Primary Examiner*—A. C. Prescott

*Attorney, Agent, or Firm*—Oblon, Spivak, McClelland, Maier & Neustadt

[57] ABSTRACT

A developing apparatus for an electrophotographic copier or the like includes a cylindrical developing sleeve which is rotatable to transport one component magnetic toner to a predetermined developing region where a photoconductive element is positioned. A magnet layer magnetized to have N and S poles which alternate with each other at a predetermined small distance is provided in the vicinity of the surface of the developing sleeve so as to deposit the toner on the magnetic layer. A blade is pressed against the surface of the magnet layer for frictionally charging the toner which is deposited on the magnet layer. A clearance is defined between the surface of the magnet layer and the blade and sequentially reduced in a direction of rotation of the sleeve, whereby the toner is charged and, at the same time, regulated into an even thin layer.

11 Claims, 3 Drawing Sheets

DEVELOPING APPARATUS FOR IMAGE RECORDER

BACKGROUND OF THE INVENTION

The present invention relates to a developing apparatus for an image recorder and, more particularly, to a developing apparatus installed in an electrophotographic copier or the like and including a developer transport member which carries one component magnetic toner, or developer, toward a predetermined developing region.

A developing apparatus used with, for example, an electrophotographic copier functions to supply toner, or developer, to an electrostatic latent image which is formed on a photoconductive drum or like image carrier so as to develop the latent image. Among some different types of developing apparatuses, an apparatus which uses one component magnetic toner is usually constructed such that the toner is magnetically deposited on a developer transport member having a magnet body as typified by a developing sleeve and is carried by the transport member to a predetermined developing region. For example, in a developing apparatus disclosed in Japanese Laid-Open Patent Publication (Kokai) No. 50-45639, a cylindrical developing sleeve which serves as a developer transport member is located in the vicinity of a photoconductive drum or like image carrier and has therein a magnet body having a plurality of magnetic poles arranged in an annular configuration. While one component magnetic toner is deposited on the developing sleeve by the magnetic field which is developed by the magnet body, the developing sleeve and the magnet body are rotated relative to each other to transport the toner. In this instance, the toner is charged by the frictional force which is developed between toner particles and the developing sleeve when the toner particles are sequentially moved on the surface of the sleeve while rolling on that surface.

In a developing apparatus of the kind described, should the nearby poles of the magnet body be greatly spaced apart from each other, toner particles would fail to be deposited on the developing sleeve thin and uniformly. In the light of this, there has been proposed a developing apparatus in which a magnet body is magnetized to have different magnetic poles which alternate with each other at a predetermined small distance. Such an apparatus is capable of forming a thin layer of toner particles because the numerous different magenetic poles which are close to each other allow a small amount of toner particles to be surely deposited on the individual poles. However, a decrease in the distance between nearby poles is accompanied by a decrease in the magnetic field which is developed between the nearby poles. Should the magnetic field be decreased to fail to reach the outside of the developing sleeve, the magnet body would become unable to magnetically attract the toner particles and, therefore, to produce an even toner layer. Although a magnet member with magnetic poles which alternate with each other at a small distance may be driven to rotate at a high speed so as to provide an even toner layer as has already been proposed, the high speed rotation cannot be implemented without a driving mechanism which is apt to produce noise. Another drawback is that the high speed rotation of the magnet body generates a vortex current on the surface of the developing sleeve resulting in the generation of heat.

In another prior art developing apparatus, the magnet body disposed in the developing sleeve is replaced with a charging member in the form of a blade which is pressed against the surface of a developing sleeve. The charging blade serves to frictionally charge toner due to its pressing contact with the developing sleeve while thinning a toner layer to a predetermined thickness. With the charging blade only, however, the apparatus cannot cause a sufficient amount of toner to be forced into the pressing portion of the blade because toner is not deposited by a sufficient force on the developing sleeve, resulting in the friction being insufficient.

SUMMARY OF THE INVENTION

It is, therefore, an object of the present invention to provide a developing apparatus for an image recorder which with a simple structure allows toner on a developer transport member to be regulated to an even thin layer while promoting sufficient frictional charging of toner.

It is another object of the present invention to provide a generally improved developing apparatus for an image recorder.

A developing apparatus installed in an image recorder for developing an electrostatic latent image provided on an image carrier by using one component magnetic toner of the present invention comprises developer transporting means for transporting the toner to a predetermined developing region by carrying the toner therewith, the developer transporting means comprising a magnet member magnetized to have different magnetic poles which alternate with each other at a predetermined small distance for depositing particles of the toner on a surface of the magnet member, charging means pressed against the surface of the magnet member for frictionally charging the particles deposited on the surface of the magnet member while regulating the particles into an even layer, and a clearance defined between the surface of the magnet member and the charging member and sequentially decreasing in an intended direction of transport of the developer transporting means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
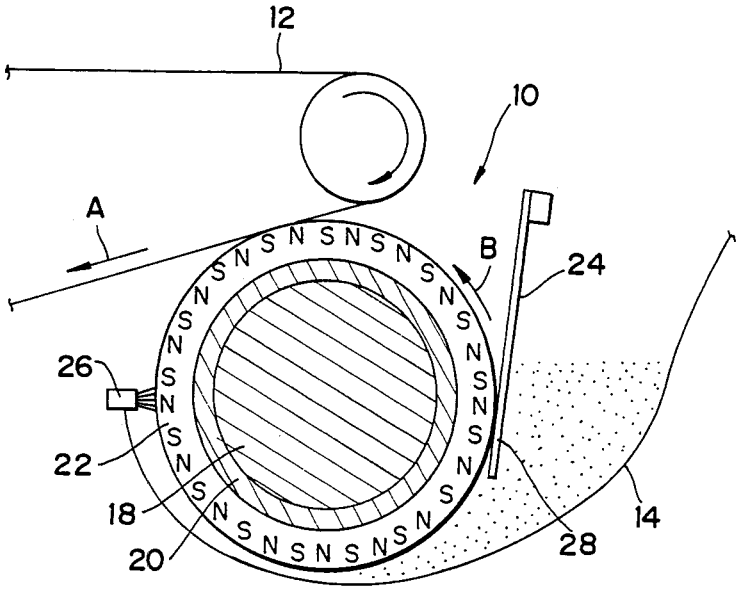
FIG. 1 is a schematic vertical section of a developing apparatus embodying the present invention.

Referring to FIG. 1 of the drawings, a developing apparatus in accordance with the present invention is shown and generally designated by the reference numeral 10. The apparatus 10 adjoins an endless photoconductive belt 12 which serves as an image carrier. Implemented with an organic photoconductor (OPC), the belt 12 is driven to rotate in a direction indicated by an arrow A and at a speed of Vp which, in this particular embodiment, is approximately 115 millimeters per second. The belt 12 is uniformly charged and then exposed imagewise at appropriate stations, not shown, whereby a latent image is electrostatically formed on the belt 12.

A developing sleeve, or developer transport member, 16 is rotatably received in a toner container 14 which is included in the apparatus 10. The developing sleeve 16 is rotated such that tonr deposited thereon is transported counterclockwise as indicated by an arrow B in contact with the surface of the belt 12. In the illustrative embodiment, the developing sleeve 16 is provided with an outside diameter of 25.4 millimeters and rotated at a rate of 351 revolutions per minute. The developing sleeve 16 is made up of a cylindrical shaft 18, a hollow cylindrical conductive layer 20 which surrounds the shaft 18, and an annular magnet layer 22 which surrounds the conductive layer 20. A part of the surface of the magnet layer 22 which does not make contact with the belt 12 is buried in one component magnetic toner which is stored in the toner container 14. The magnetic force of the magnet layer 22 causes particles of the toner to deposite on the magnetic layer 22.

The magnet layer 22 is made of EPDM rubber with a barium-ferrite magnetic material dispersed therein and, in this embodiment, it is 0.8 millimeters thick. the magnet layer 22 is magnetized to have S and N poles which alternate with each other at a small distance as illustrated. For example, the magnet layer 22 may be provided with sixty S poles and sixty N poles and designed to have a 220 gauss peak. The S and N poles are arranged at a pitch I (millimeter) which satisfies an equation:

$$I/(Vp/VS)=0.33 \text{ (millimeter )}$$

where Vp is the speed of movement of the belt 12 (millimeter per second), and Vs is the peripheral speed of the developing sleeve 16 (millimeter per second).

A charging member in the form of a blade 24 is located upstream of the position where the belt 12 and sleeve 16 are held in contact, with respect to the direction of rotation of the sleeve 16. The blade 24 is uniformly pressed against the magnet layer 22 of the sleeve 16 in the widthwise direction of the latter. The blade 24 functions to frictionally charge the toner deposited on the magnet layer 22 and to regulate the toner layer into an even thin layer. Defined between the blade 24 and the surface of the sleeve 16 is a wedge-like clearance 28 which sequentially decreases in the rotating direction B of the sleeve 16. The clearance 28 has a function of frictionally charging toner particles and a function of regulating the toner layer. The blade 24 is made of stainless steel or PK metal available from Hitachi Metals Co. Ltd. The use of metal is to take advantage of resiliency particular thereto. Specifically, the blade 24 made of metal can be slightly deformed to develop between the blade 24 and the sleeve 16 an adequate pressure for depositing an appropriate amount of charge on the toner, and it well withstands friction with the toner and sleeve 16. If desired, however, the blade 24 may be implemented by resin or the like. The blade 16 may be 0.1 millimeters thick by way of example. A discharging member in the form of a brush 26 is located downstream of the developing region where the belt 12 and the sleeve 16 make contact. After the development effected in the developing region, the brush 26 removes the charge which remains on the surface of the sleeve 16.

In operation, the toner particles stored in the toner container 14 are magnetically adhered to the magnet layer 22 of the developing sleeve 16 just above the magnetic poles of the magnet layer 22. Since the magnetic poles of the magnet layer 22 are arranged at a small distance, the toner particles become deposited substantially evenly on the magnetic layer 22 in a thin layer configuration. The resulting toner layer on the sleeve 16 is transported by the sleeve 16 toward the region where the blade 24 is held in pressing contact with the sleeve 16.

Figure 2:
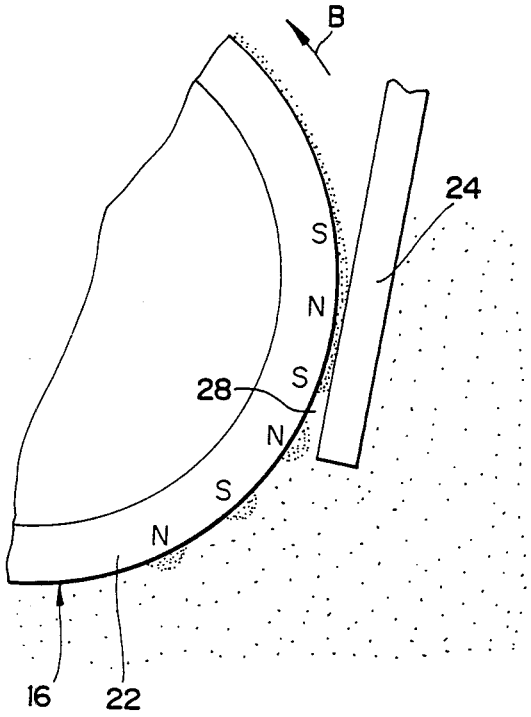
FIG. 2 is a fragmentary enlarged view schematically showing a charging member which is pressed against a developing sleeve.

As shown in an enlarged scale in FIG. 2, the toner layer formed on the sleeve 16 is forced into and frictionally charged in the clearance 28 which sequentially decreases in the direction B, as stated earlier. During the frictional charging, the toner particles are positively retained by the magnet layer 22 of the sleeve 16 due to the magnetic force of the magnet layer 22 and are therefore driven into the clearance 28 in a desirable condition. Consequently, the toner particles are surely rubbed against the blade 24 to be thereby uniformly charged based on friction. Simultaneously, the toner particles being sequentially forced into the clearance 28 are leveled. Specifically, the gaps between the lumps of toner particles which are individually directly deposited on the sleeve 16 just above the magnetic poles, i.e., those portions where the toner particles are not directly deposited on the sleeve 16 are filled with those toner particles which have been removed by the blade 24. This further enhances the evenness of the toner layer.

The thin toner layer produced as described above is transported to the developing region and supplied to the latent image which is provided on the belt 12. Due to the even toner layer, the supply of toner for development itself is effected uniformly to in turn uniformize the distribution of bias voltage which is adapted for development. Consequently, the latent image is developed without any irregularity and without the background area being contaminated. The charge remaining on the sleeve 16 after the development is removed by the brush 26. That surface of the sleeve 16 from which the remaining charge is removed is returned into the toner container 14 as the sleeve 16 is rotated. In this condition, another developing cycle may be is initiated.

Figure 3:
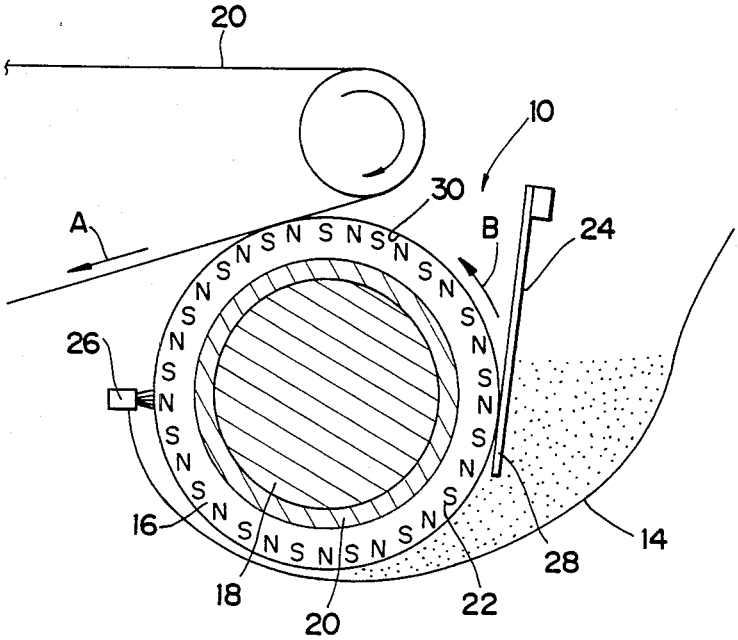
FIG. 3 is view similar to FIG. 1, showing another embodiment of the present invention.

Referring to FIG. 3, another embodiment of the present invention is shown. In the figure, the same or similar structural elements as those shown in FIG. 1 are designated by like reference numerals. As shown, the surface of the developing sleeve 16 is coated with a thin charging layer 30. The charging layer 30 is made of a material capable of sufficiently charging toner particles and is thin enough to sufficiently extend the magnetic force to the outside.

In summary, it will be seen that the present invention provides a developing apparatus for an image recorder which sufficiently charges toner particles by friction while leveling the toner particles into an even thin layer.

Various modifications will become possible for those skilled in the art after receiving the teachings of the present disclosure without departing from the scope thereof.

What is claimed is:

1. A developing apparatus installed in an image recorder for developing an electrostatic latent image provided on an image carrier by using one component magnetic toner, comprising:

developer transporting means for transporting said toner to a predetermined developing region by carrying said toner therewith, said developer transporting means comprising a magnet member magnetized to have different magnetic poles which alternate with each other at a predetermined small distance for depositing particles of said toner on a surface of said magnet member;

charging means pressed against said surface of said magnet member for frictionally charging said particles deposited on said surface of said magnet member while regulating said particles into an even layer; and a clearance defined betweeen said surface of said magnet member and said charging member and sequentially decreasing in an intended direction of transport of said developer transporting means.

2. A developing apparatus as claimed in claim 1, wherein said developer transporting means further comprises a thin layer member provided on said surface of said magnet member for charging said particles of said toner.

3. A developing apparatus as claimed in claim 2, wherein said developer transporting means further comprises a conductive layer member provided on that surface of said magnet member which is opposite to said surface.

4. A developing apparatus as claimed in claim 3, wherein said magnet member, said thin layer member and said conductive layer member are each provided with a hollow cylindrical configuration and rotatable about a shaft.

5. A developing apparatus as claimed in claim 1, wherein said magnet member is made of EPDM rubber in which a barium-ferrite magnetic material is dispersed.

6. A developing apparatus as claimed in claim 1, wherein said magnet member has sixty S poles and sixty N poles as said magnetic poles and has a 220 gauss peak.

7. A developing apparatus as claimed in claim 1, wherein said charging means comprises a blade.

8. A developing apparatus as claimed in claim 7, wherein said blade is made of metal.

9. A developing apparatus as claimed in claim 7, wherein said blade is made of resin.

10. A developing apparatus as claimed in claim 1, wherein said clearance functions to frictionally charge said toner particles on said surface of said magnet member and to regulate said toner particles into an even layer.

11. A developing apparatus as claimed in claim 1, further comprising discharging means located downstream of said developing region with respect to said intended direction of transport of said developer transporting means for removing a charge which remains on said developer transporting means after development.

* * * * *